US009675174B2

(12) United States Patent
Jahrling et al.

(10) Patent No.: US 9,675,174 B2
(45) Date of Patent: Jun. 13, 2017

(54) PULL-OUT SYSTEM

(71) Applicant: PAUL HETTICH GMBH & CO. KG, Kirchlengern (DE)

(72) Inventors: Peter Jahrling, Bunde (DE); Daniel Rehage, Bielefeld (DE); Rudiger Brinkmann, Vlotho (DE); Benjamin Bextermoller, Melle (DE)

(73) Assignee: Paul Hettich GMBH & Co. KG, Kirchlengern (DE)

( * ) Notice: Subject to any disclaimer, the term of this patent is extended or adjusted under 35 U.S.C. 154(b) by 0 days.

(21) Appl. No.: 14/894,026

(22) PCT Filed: Jun. 4, 2014

(86) PCT No.: PCT/EP2014/061586

§ 371 (c)(1),
(2) Date: Nov. 25, 2015

(87) PCT Pub. No.: WO2014/198604

PCT Pub. Date: Dec. 18, 2014

(65) Prior Publication Data

US 2016/0128475 A1 May 12, 2016

(30) Foreign Application Priority Data

Jun. 14, 2013 (DE) ..... 10 2013 106 235
Dec. 9, 2013 (DE) ..... 10 2013 113 672

(51) Int. Cl.
*A47B 88/483* (2017.01)
*A47B 88/40* (2017.01)
(Continued)

(52) U.S. Cl.
CPC ..... *A47B 88/12* (2013.01); *A47B 88/40* (2017.01); *A47B 88/483* (2017.01);
(Continued)

(58) Field of Classification Search
CPC ..... A47B 88/12; A47B 88/04; A47B 88/10; A47B 2210/0083; A47B 2210/0072;
(Continued)

(56) References Cited

U.S. PATENT DOCUMENTS 363,647 A * 5/1887 Knau ..... A47B 88/493 312/331
399,752 A 3/1889 Horrocks
(Continued)

FOREIGN PATENT DOCUMENTS

DE 8111242 U1 1/1982
DE 3936754 5/1991
(Continued)

OTHER PUBLICATIONS

Search Report issued in German app. No. 10-2013-113672.9 (2013).
Search Report issued in Int'l App. No. PCT/EP2014/061586 (2014).

*Primary Examiner* — Muhammad Ijaz
(74) *Attorney, Agent, or Firm* — Barnes & Thornburg LLP

(57) ABSTRACT

A pull-out system comprises at least two pull-out guides, each pull-out guide having a stationary rail and at least one rail that can be moved relative to the stationary rail, means for synchronizing the movement of the movable rails being provided, said means comprising at least one flexible deflector element for synchronization. In this way, the movement of wide or heavy pull-out units can be synchronized in a simple manner, producing little noise.

11 Claims, 10 Drawing Sheets

(51) Int. Cl.
*A47B 88/493* (2017.01)
*A47B 88/12* (2006.01)

(52) U.S. Cl.
CPC .... *A47B 88/493* (2017.01); *A47B 2210/0059* (2013.01); *A47B 2210/0072* (2013.01); *A47B 2210/0083* (2013.01)

(58) Field of Classification Search
CPC ..... A47B 2210/0059; A47B 88/483; A47B 88/40; A47B 88/493
USPC ..... 248/241, 249, 268, 693, 659; 312/408, 312/402, 404, 331, 333
See application file for complete search history.

(56) References Cited

U.S. PATENT DOCUMENTS 2,320,546 A * 6/1943 Shakespeare ..... F16G 11/10 24/69 T
3,687,505 A * 8/1972 Fall ..... A47B 88/493 312/110
3,722,964 A * 3/1973 Chitester ..... A47B 88/493 312/331
4,351,135 A * 9/1982 Freller ..... B66C 23/04 52/118
4,370,932 A * 2/1983 Etcheparre ..... B66C 11/16 104/173.1
5,492,400 A * 2/1996 Rock ..... A47B 88/493 312/331
5,564,807 A * 10/1996 Rock ..... A47B 88/493 312/331
8,764,135 B1 * 7/2014 Huang ..... A47B 88/40 312/331
2005/0016070 A1 * 1/2005 Cardine ..... E05F 11/485 49/352
2009/0045713 A1 * 2/2009 Kunkle ..... A47B 88/40 312/402
2009/0261698 A1 * 10/2009 Cabal Velarde ..... A47B 88/493 312/334.8
2016/0128475 A1 * 5/2016 Jahrling ..... A47B 88/483 248/241
2016/0345730 A1 * 12/2016 Lim ..... A47B 96/07

FOREIGN PATENT DOCUMENTS

DE 10-2008-012100 U1 5/2009
DE 10-2013-103257 10/2014
WO WO 2012/065880 5/2012

* cited by examiner

PULL-OUT SYSTEM

CROSS REFERENCE TO RELATED APPLICATION

This application is a U.S. nationalization under 35 U.S.C. §371 of International Application No. PCT/EP2014/061586, filed Jun. 4, 2014, which claims priority to German Patent Application No. 10 2013 106 235.0, filed Jun. 14, 2013, and German Application No. 10 2013 113 672.9, filed Dec. 9, 2013. The disclosures set forth in the referenced applications are incorporated herein by reference in their entireties.

BACKGROUND AND SUMMARY OF THE DISCLOSURE

The present invention relates to a pull-out system comprising at least two pull-out guides, wherein each pull-out guide comprises a stationary rail and at least one rail that can be moved relative to the stationary rail, and means for synchronising the movement of at least one movable rail.

WO 2012/065880 discloses a pull-out guide in which a middle rail is provided between a running rail and a guide rail, and the movement of the rails is controlled via a cable-operated control system. It can thus be avoided that during a movement of the running rails the rails will slip relative to each other and an oblique positioning of a drawer element occurs in the case of such slippage. In addition, striking noises can thus also be reduced considerably. Although such a cable-operated control unit can control the movement of the middle rail and the running rail relative to the guide rail, the problem may occur, especially in wide drawer elements, that the pull-out guides on opposite sides are moved in an offset manner, and an undesirable oblique positioning of the drawer element will occur.

EP 2 165 624 discloses a synchronous guide for a drawer element comprising a coupling rod in order to synchronise the movement of the rails of two mutually spaced pull-out guides. The problem can occur in such rigid synchronisation devices that they are mechanically heavily loaded in the case of heavy drawer elements and the operating lifespan is thus limited. In addition, tolerance compensation can be provided only within limits. Pinions and toothed racks are often used in rigid synchronisation devices, through which disturbing noises can be generated during the displacement of the pull-out system.

The present disclosure is directed to a pull-out system with at least two pull-out guides in which the movement of the displaceable rails is synchronised in a simple way.

In accordance with the disclosure, the synchronisation mechanism comprises at least one flexible deflection element in order to synchronise a movement of the movable rails of the at least two pull-out guides. As a result, the transfer of forces does not occur via rigid elements such as coupling rods, but the flexible deflection element ensures the synchronisation between the movable rails of the pull-out guides, which enables simple mounting and permits tolerance compensation. Even when a drawer element is pulled on one side, opening is also ensured on the opposite side of the drawer element through the synchronisation mechanism, wherein the low weight of the flexible deflection element ensures smooth movement. In addition, a very quiet and smoothly running synchronisation is achieved by using the flexible deflection element.

According to an embodiment, the synchronisation mechanism is coupled to at least one movable rail. The synchronisation mechanism can then be displaced together with the at least one movable rail, e.g. the middle rail of a pull-out guide formed by three rails.

The flexible deflection element is arranged with one section parallel to the longitudinal direction of a pull-out guide and perpendicular to the longitudinal direction on a connecting section. As a result, the connecting section can be moved together with at least one rail of the two pull-out guides, while the sections parallel to the longitudinal direction of the pull-out guides are tensioned via their deflection elements. The flexible deflection element can be guided via at least one deflection pulley on the rail. Deflection on each pull-out guide on the deflection pulley can be carried out about approximately 180°.

The flexible deflection element can be surrounded at least partly by an enclosure in a connecting section between the pull-out guides. The enclosure can also be flexibly formed as a cable conduit. The tension of the deflection element can be adjusted in a simple way via the enclosure, in that the length of the enclosure is formed in an adjustable way. The enclosure absorbs forces in the axial direction. This can occur in a simple manner by respective thread adjustments. One or several means may thus be provided in order to set the tension of the flexible deflection element. In addition, the enclosures can be guided by guide elements, preferably in the region of the deflection pulleys, so that the flexible deflection element can be transferred in a defined manner to the deflection pulleys.

The tension of the flexible deflection element can be adjusted via a spring. A defined force for pretensioning the flexible deflection element can be applied via the spring, so that errors during mounting can be avoided. The set pretension can then be fixed via a locking means, so that during a movement of a rail of the pull-out system the set pretension does not change.

The flexible deflection element may be in the form of a looped cable or belt. An element that changes very little with respect to its length can be used as a deflection element, e.g. a band or a cable or a belt. A wire cable whose length changes only marginally under a tensile load may be used as a deflection element. Alternatively, the flexible deflection element can also consist of several (for example, four) subcomponents which are at least operatively connected.

A pull-out system in accordance with the disclosure may comprise two pull-out guides, which comprise a stationary rail, a running rail and an interposed middle rail, wherein the flexible deflection element is retained on the middle rail. The flexible deflection element can then be fixed at a first connection point to the stationary rail and at the second connection point to the running rail, so that the movement of the rails of a pull-out guide is also controlled by the synchronisation mechanism. Such a sequence control ensures that the running rail moves with twice the speed as the middle rail.

Alternatively, the flexible deflection element can also be arranged together with the deflection pulleys as a separate module on at least one support, which is detachably or non-detachably connectable to the middle rail or any other rail, e.g. by means of a snap-on connection. As a result, the flexible deflection element can be retrofitted without any major effort in existing pull-out guides. It is only necessary to retrofit the connections to the at least one further rail by clipping on for example. Alternatively, the connections can be formed by elements on the rail which carries the support, or on the support per se, which interact with respectively formed regions of the at least one further rail, e.g. grooves or projections. In the case of improper use of the pull-out system, these elements can be deflected and a destruction of the synchronisation can thus be prevented.

The pull-out guide in accordance with the disclosure can further comprise a self-retracting mechanism and/or damping and/or an opening apparatus, which can be provided in addition to the synchronisation. The activator for these additional components can advantageously be arranged on the flexible deflection element. As a result of the synchronisation in accordance with the invention, an arrangement of a self-retracting mechanism or an opening apparatus on one side of the pull-out system is sufficient. Costs can thus be reduced.

The pull-out system can be used in a domestic appliance or a piece of furniture, but other applications are also possible.

DETAILED DESCRIPTION OF THE DRAWINGS

Figure 1:
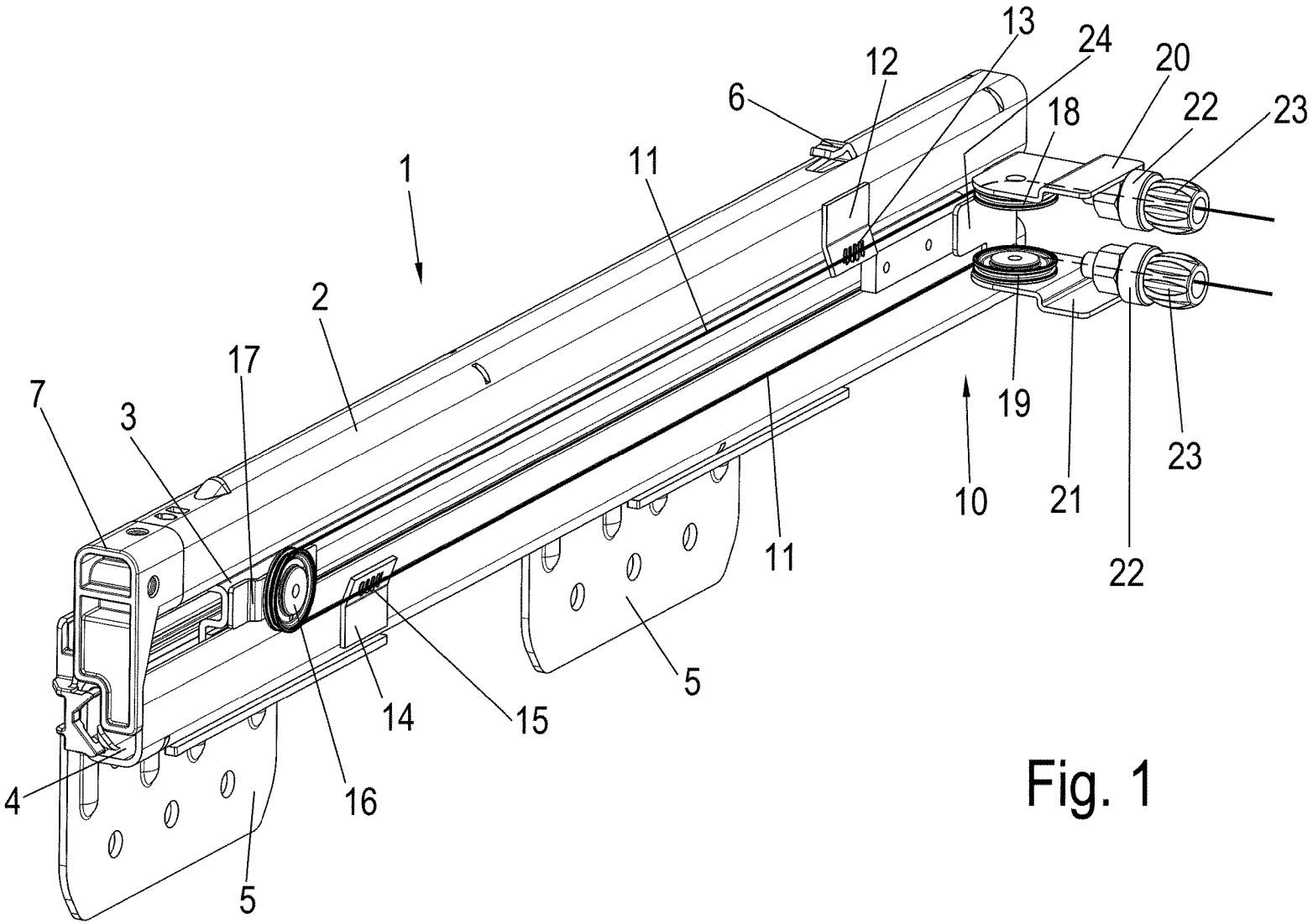
FIG. 1 shows a perspective view of a pull-out guide of a pull-out system in accordance with the disclosure.

A pull-out system comprises two pull-out guides 1, wherein FIG. 1 only shows one of these pull-out guides 1. The pull-out guide 1 comprises a running rail 2, which can be coupled to a drawer element such as a drawer, a receiving basket or any other drawer element. The running rail 2 is movably mounted on a middle rail 3 via rolling bodies, wherein the middle rail 3 is movable via further rolling bodies relative to a stationary rail 4. The stationary rail 4 can be fixed via mounting brackets 5 to a body of a piece of furniture or a domestic appliance.

An upwardly protruding hook 6 is provided on the running rail 2 of the pull-out guide 1, which hook is connectable for connecting to the drawer element such as a drawer or a basket. Furthermore, a plug 7 is provided on the front side of the running rail 2, which plug is used as a limit stop and can be coupled to a self-retracting mechanism or the damping device.

In order to synchronise the movement of the running rail 2 with the running rail 2 of a further pull-out guide 1, synchronisation mechanism 10 is provided which may comprise a flexible deflection element 11. The flexible deflection element 11 is formed as a cable from a wire, but can be any other cable, band or other element which is deflectable. The flexible deflection element 11 is coupled via a retainer 12 to the running rail 2, wherein the flexible deflection element 11 is fixed to the retainer 12 at a connection point 13. A retainer 14 is similarly provided on the stationary rail 4, wherein the flexible deflection element 11 is fixed to the retainer 14 at a connection point 15. The flexible deflection element can be fixed to the retainers 12 and 14 at the connection points 13 and 15 by welding, gluing or by means of mechanical fastening means.

The flexible deflection element 11 is deflected in the front region around a deflection pulley 16 by approximately 180°, which deflection pulley is rotatably mounted on a retainer 17 which is fixed to the middle rail 3. Sequence control can occur through the flexible deflection element 11 between the running rail 2, the middle rail 3 and the stationary rail 4, which ensures that the running rail 2 is moved twice as fast as the middle rail 3 and slippage between the rails is prevented.

The synchronisation mechanism 10 further comprises guide means in order to guide the flexible deflection element 11 from a pull-out guide 1 to the opposite pull-out guide 1. A further retainer 24 is provided for this purpose on the rear side on the middle rail 3, on which an upper deflection pulley 18 and a bottom deflection pulley 19 are provided, which comprise a substantially vertical axis. Other than in the case of a deflection pulley 16 which is rotatable about a horizontal axis, the flexible deflection element 11 can be deflected horizontally on the deflection pulleys 18 and 19. A ring 22 is further provided on the upper retainer 20 with the deflection pulley 18, which ring is connected via a threaded sleeve 26 to a knurled nut 23. A ring 22 with a threaded sleeve 26 is provided in a similar way on the bottom retainer 21, on which a further knurled nut 23 is twisted. The tension of the flexible deflection element 11 can thus be adjusted, as will be explained below in closer detail. Alternatively or additionally, the tension of the flexible deflection element 11 can also be set via a displacement of the retainer 17 and/or the retainer 24 parallel to the longitudinal direction of the pull-out guide 1. Slots can be provided for this purpose on the retainers 17, 24.

Figure 2A:
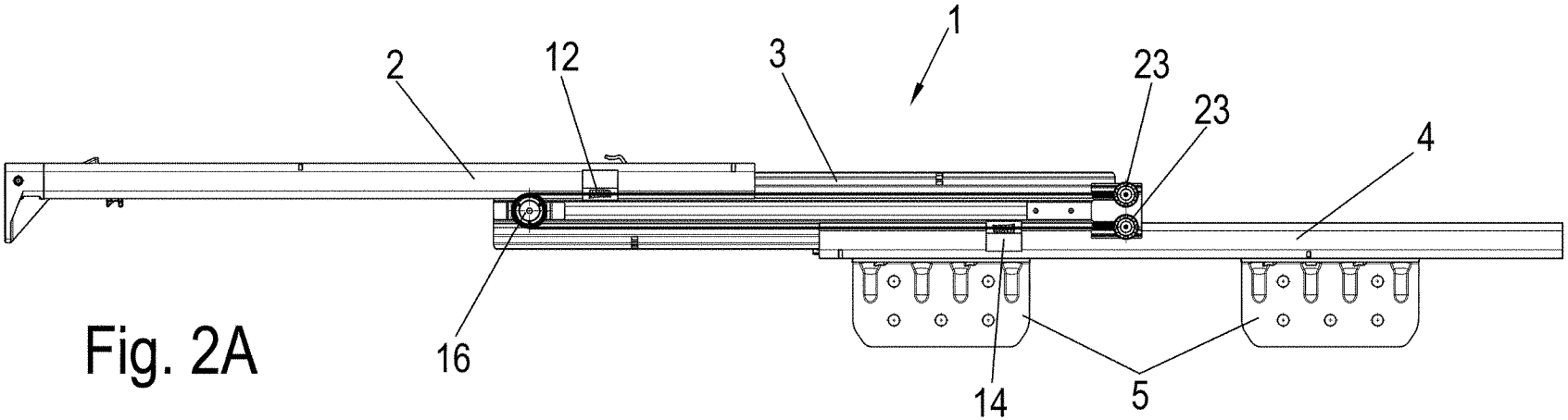
FIGS. 2A and 2B show two side views of the pull-out guide of FIG. 1 in different positions.
Figure 2B:
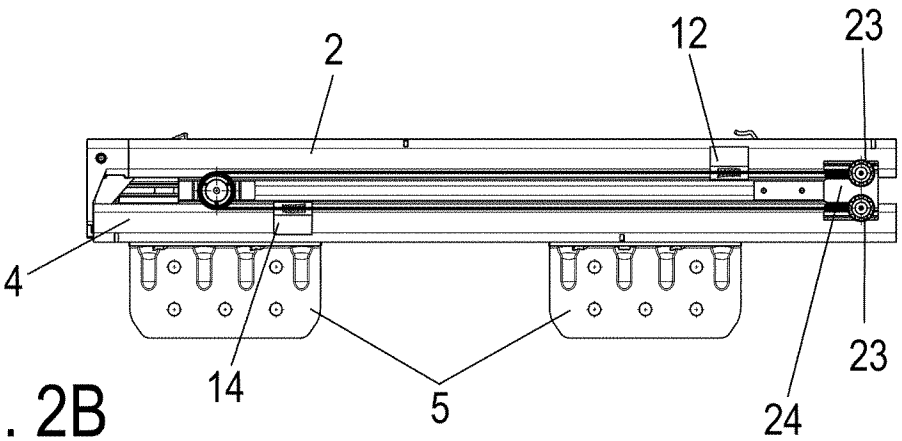

The pull-out guide 1 is shown in different positions in FIGS. 2A and 2B. In FIG. 2A, the pull-out position is shown in which the running rail 2 is completely displaced in front of the stationary rail 4. In FIG. 2B, the retraction or closing position is shown in which the running rail 2 and the stationary rail 4 are arranged on top of each other.

Figure 3:
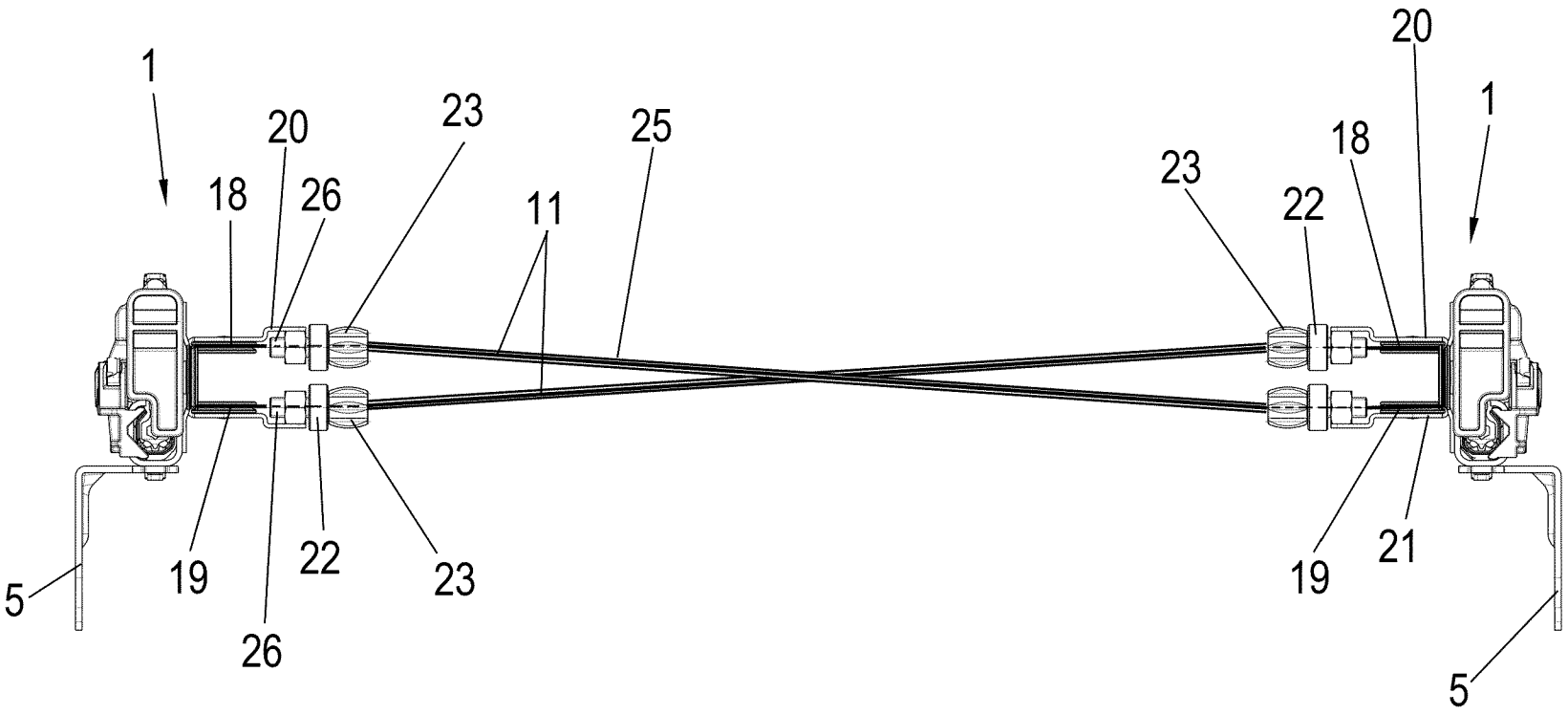
FIG. 3 shows a front view of the pull-out system with two pull-out guides.

FIG. 3 shows the pull-out system with two pull-out guides 1, which are connected to each other in a rear region, i.e. the connecting region, via the flexible deflection element 11. The flexible deflection element 11 is guided by the threaded sleeves 26 and by the respective knurled nuts 23 and is then arranged in an enclosure 25 which is formed as a flexible tube for example. When the flexible deflection element 11 is to be tensioned, the distance between the knurled nuts 23 and the pull-out guide can be changed slightly by twisting at least one of the knurled nuts 23, preferably both said nuts, arranged on a retainer, relative to the ring 22, through which the flexible deflection element is selectively tensioned or relaxed. The threaded sleeves 26 are used for fixing the set tension.

Figure 4A:
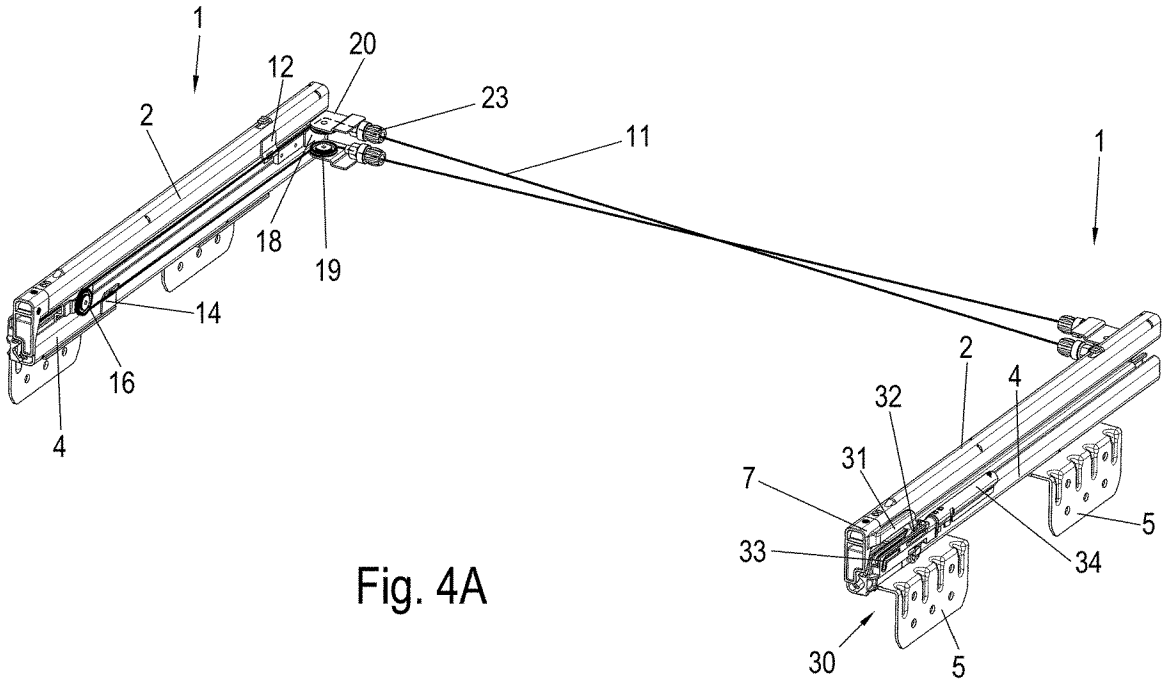
FIGS. 4A and 4B show two perspective views of a pull-out system in accordance with the disclosure in different positions.

As is shown in FIG. 4A, two pull-out guides 1 are spaced from each other and are coupled to each other in the rear region via the flexible deflection element 11, wherein in FIG. 4A the enclosure 25 was omitted for the purpose of improved graphical illustration. The flexible deflection element 11 is formed circumferentially and, originating from the retainer 12 on the running rail 2 on the left side, is guided around the deflection pulley 16 and then connected to the stationary rail 4 of the left pull-out guide 1. In the region of the pull-out guide 1, the flexible deflection element 11 is oriented parallel to the rails 2, 3, 4. In the rear region, the deflection pulleys 18 and 19 ensure that the flexible deflection element 11 is deflected about approximately 90°. The pull-cut guide 1 on the right side can be formed as a mirror image of the pull-out guide 1 on the left side, wherein the flexible deflection element is respectively arranged on the inner side. The region of the flexible deflection element 11, which is connected to the retainer 14 on the left pull-out guide 1, is coupled on the opposite right pull-out guide 1 with a retainer 12 to the running rail 2. Conversely, the section which is connected to the stationary rail 4 with the retainer 14 on the left side is guided via the deflection pulley 19 towards the opposite side to the pull-out guide 1 and is connected there via a deflection pulley 18 to a retainer 12 which is fixed to the running rail 2.

Figure 4B:
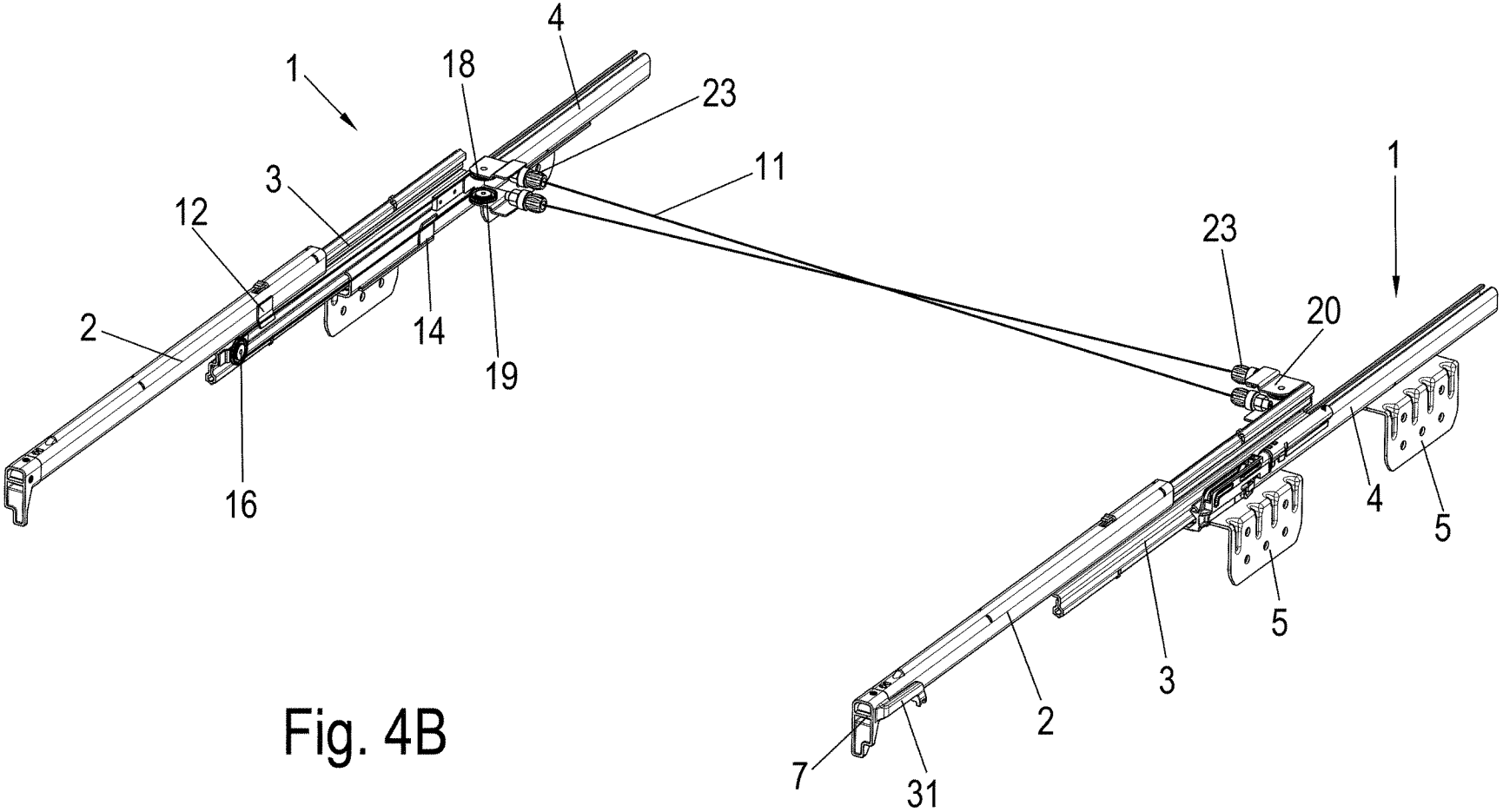

As is shown in FIG. 4B, the flexible deflection element 11 moves together with the two middle rails 3 in the rear region, wherein a synchronisation of the movement of the running rails 2 occurs in such a way that in the case of a unilateral loading via the flexible deflection element 11 the pull-out guide 1 on the opposite side is also displaced. This substantially prevents an extreme oblique positioning of a drawer element.

As is shown in FIGS. 4A and 4B, the right pull-out guide comprises a web-shaped activator 31 on the running rail 2, which activator can be coupled to a self-retracting mechanism 30. The self-retracting mechanism 30 comprises a driver 32 which can be moved along a guide 33. The driver 32 is coupled to a spring element in a cartridge 34, so that the pull-out guide 1 can be drawn to a closed position shortly before the closing position. It is alternatively or additionally possible to provide a damper in the cartridge 34 in order to brake a movement of the running rail before reaching the closing position. A respective self-retracting mechanism and/or damper can also be mounted on the opposite side on the pull-out guide 1.

In the illustrated embodiment, the flexible deflection element 11 is in the form of a continuous loop. It is also possible to provide synchronisation with a flexible deflection element 11 in which no loop-shaped arrangement is present but only a connection between two pull-out guides with two free end sections.

Figure 6:
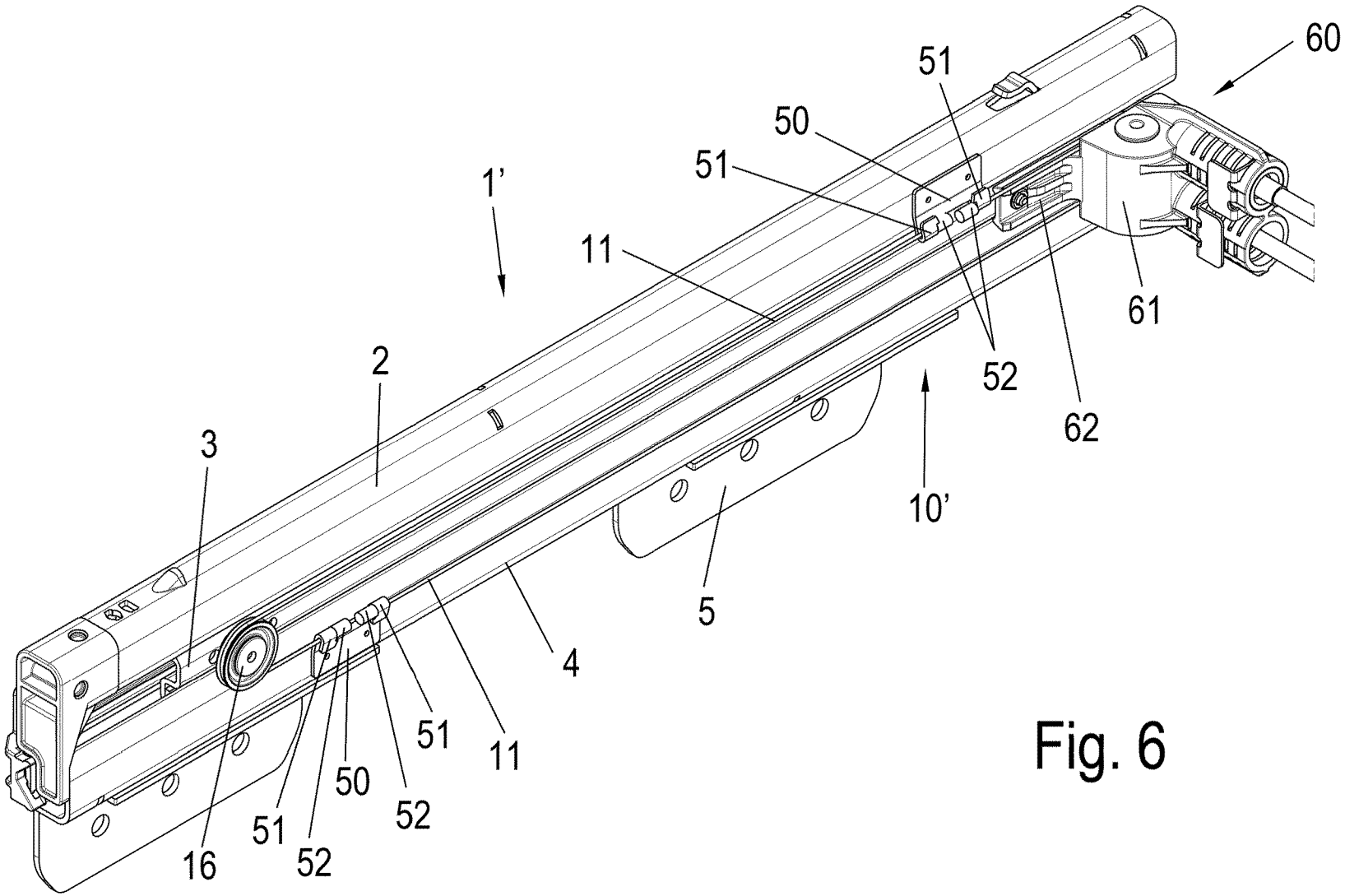
FIG. 6 shows a perspective view of a further embodiment of a pull-out guide of a pull-out system in accordance with the disclosure.

FIG. 6 shows a modified embodiment 1' in which a running rail 2 is movably mounted via a middle rail 3 on a stationary rail 4, as in the preceding embodiment. For the purpose of synchronising the movement with a pull-out guide 1' arranged in a mirror-inverted manner, a synchronisation mechanism 10 is provided which comprises a flexible deflection element 11 in form of a wire cable. The flexible deflection element 11 is not formed circumferentially, but is composed of several subsections. A first retainer 50 is fixed to the running rail 2, e.g. by welding or gluing, on which two mutually spaced hooks 51 are provided. Each hook 51 engages around an end section of the flexible deflection element 11, which is arranged adjacent to an enlarged end section 52. It is ensured by the hook 51 that the enlarged end section 52 cannot be pulled out by the hook 51, so that the flexible deflection element 11 can be held via the retainer 50 with the desired tension.

Furthermore, a further retainer 50 is fixed to the stationary rail 4, which also comprises two mutually spaced hooks 51, which are respectively arranged adjacent to an enlarged end section 52, so that a subsection of the flexible deflection element 11 with two enlarged end sections 52 can respectively be hooked into the hook 51. This assists in the mounting of the flexible deflection element 11, which can be mounted in several steps on the two pull-out guides 1'.

A guide apparatus 60 for the flexible deflection element 11 is formed in the rear region of the pull-out guide 1' on the middle rail 3, wherein the flexible deflection element 11 is deflected substantially about 90°. The guide apparatus 60 comprises a housing 61 in which respective deflection pulleys are arranged. The housing 61 is fixed via a retaining section 62 to the middle rail 3.

Figure 7:
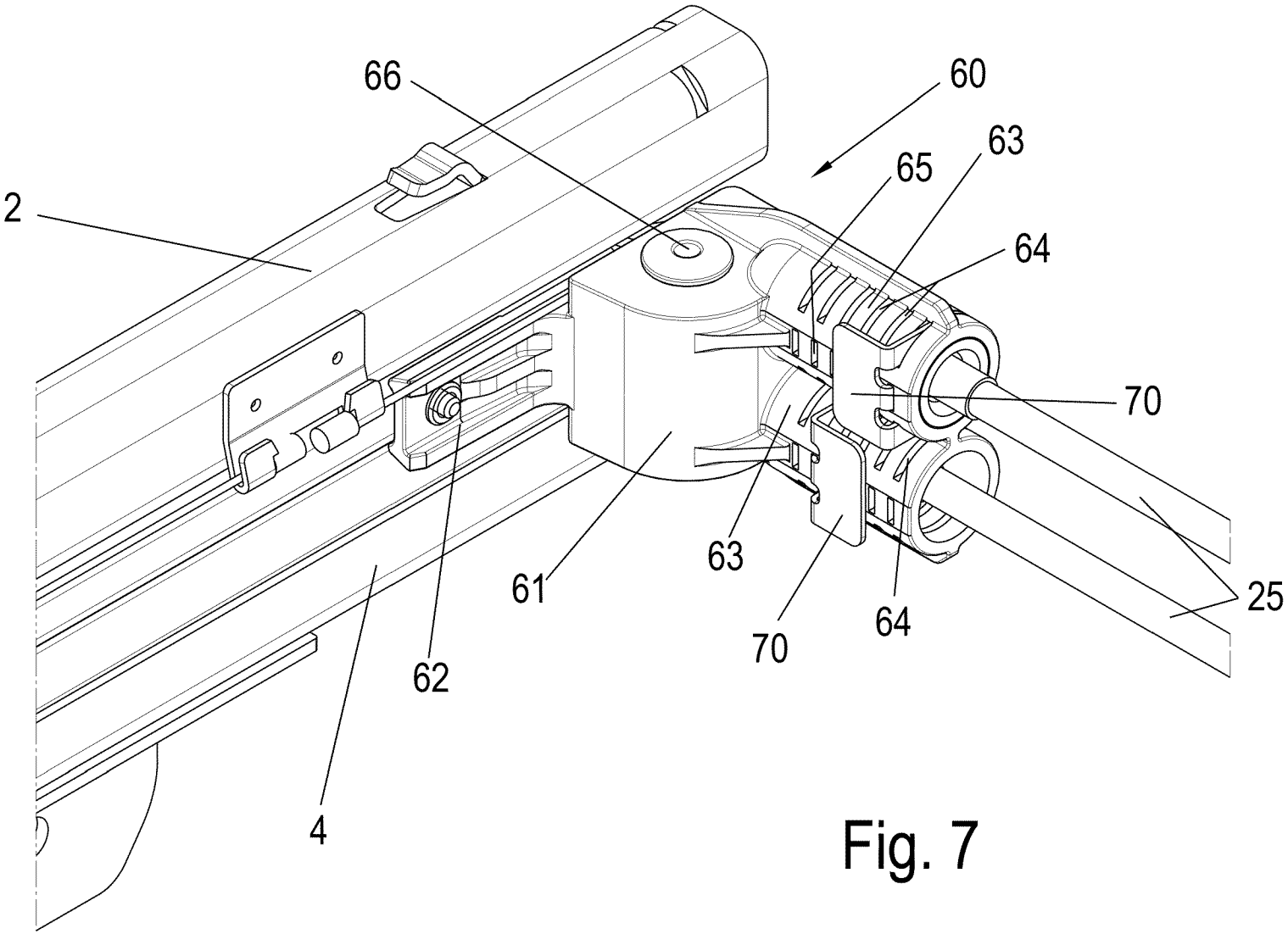
FIGS. 7 to 9 show several partial views of a device for setting the pretensioning of the flexible deflection element of the pull-out guide of FIG. 6.

As is shown in FIG. 7, the guide apparatus 60 further comprises two sleeves 63 through which a respective flexible deflection element 11 is guided. Each sleeve 63 comprises several lateral slots 64 and middle slots 65. A locking element 70 is inserted into the slots 64 and 65, by means of which a tension set in the flexible deflection element 11 can be fixed.

Figure 8:
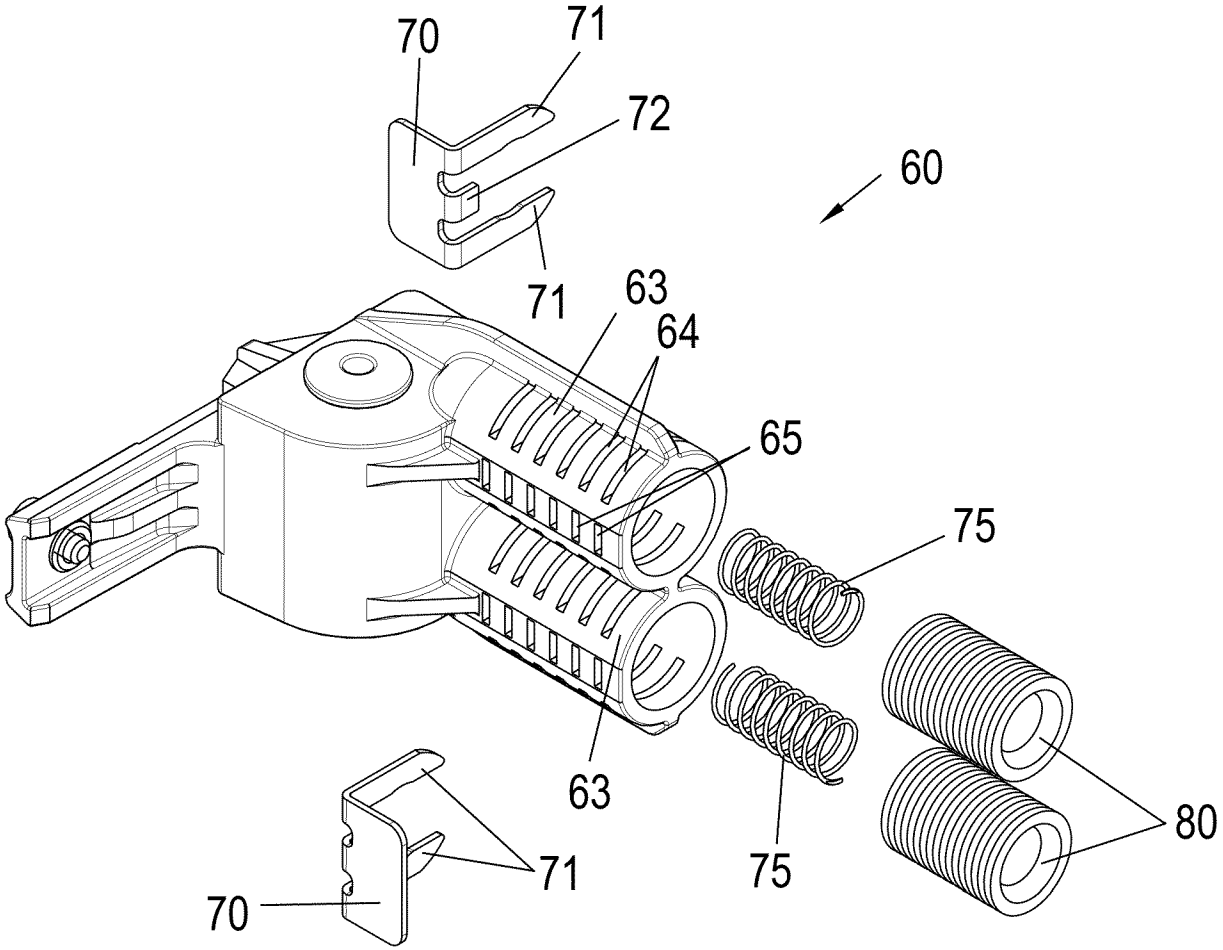

The guide apparatus 60 and the tensioning device are shown in FIG. 8 in closer detail. Springs 75 in form of coil springs can be inserted into the sleeves 63, which springs act on the tensioning sleeves 80 which can be fixed within the sleeves 63.

The tensioning device further comprises the locking elements 70, which are formed as an angle and comprise two parallel webs 71, between which a middle web 72 is arranged. The middle web 72 can be inserted into the middle slots 65 and the lateral slots 71 into the slots 64 on the sleeves 63.

Figure 9:
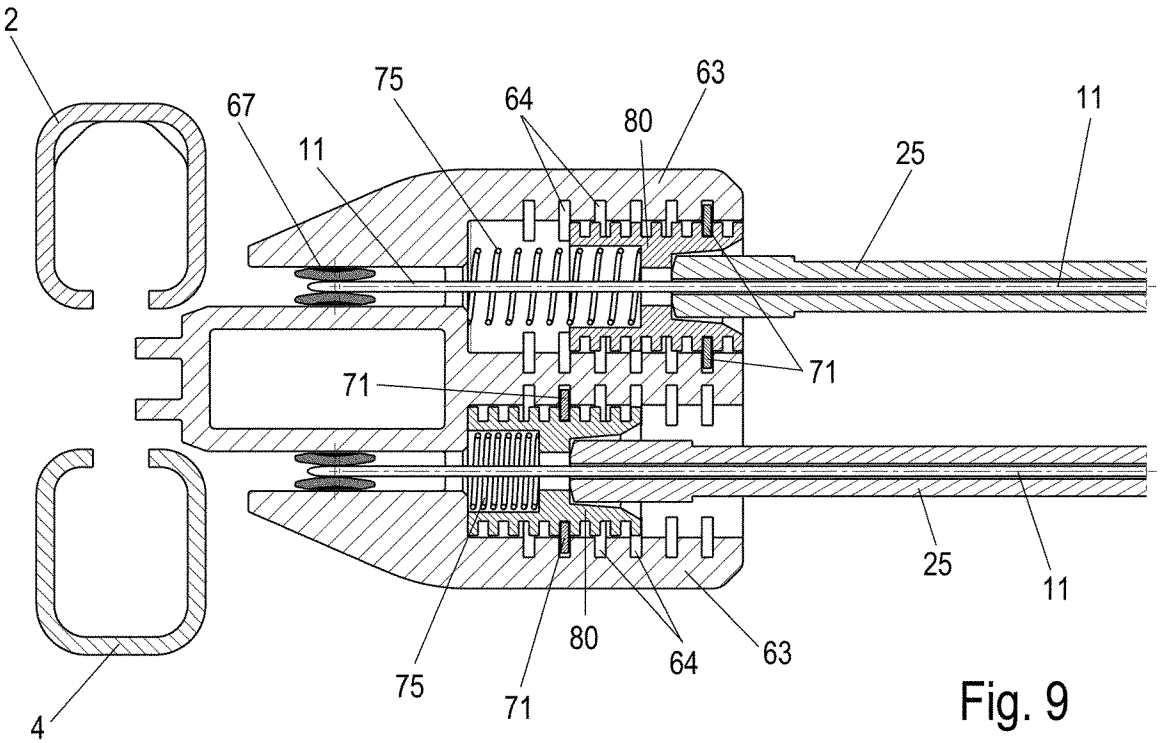

The function of the tensioning device is shown in FIG. 9. The deflection pulleys 67 are rotatably mounted about an axis 66 (FIG. 7) in the guide apparatus 60 in order to deflect the two deflection elements 11 by 90° each. In order to set the tension of the flexible deflection element 11 or a partial section of the flexible deflection element 11, the spring 75 is supported within a sleeve 63 on one side and rests on the opposite side on an inner projection of the tensioning sleeve 80. The tensioning sleeve 80 acts on the opposite side on an enclosure 25 which is arranged around the flexible deflection element 11. When the tensioning sleeve 80 is moved to the right in FIG. 9, the section of the enclosure 25 which is arranged between the opposite housing 61 is extended while the flexible deflection element 11 is tensioned. If the tensioning sleeve 80 is moved to the left however, as is shown in the bottom tensioning sleeve 80, the length of the enclosure 25 which is arranged between the opposite housing 61 is reduced, so that the tension on the flexible deflection element 11 is reduced. The displacement of the tensioning sleeve 80 does not change the actual length of the enclosure 25, only the free visible length which is arranged between the housings 61. Since the enclosure 25 is displaced independently of the deflection element 11, the pretension of the deflection element 11 can thus be set.

The spring 75 can thus predetermine the tension which is supplied to the deflection element 11. As a result, pretensioning can thus occur relatively precisely, which avoids mistakes because if the flexible deflection element 11 is guided with excessive tensioning, friction is produced and the system runs sluggishly. If on the other hand insufficient pretensioning is set, optimal synchronisation of the two pull-out guides 1' can no longer be ensured.

In order to fix a preset pretension, the locking element 17 is provided which is inserted with the webs 71 into the slots 64 when the tensioning sleeve 80 is in the desired position. Displacement of the tensioning sleeve 80 in the longitudinal direction of the deflection element 11 is thus prevented, since several grooves are provided on the outer circumference of the tensioning sleeve 80 into which a section of the web 71 engages, so that the tensioning sleeve 80 is retained in a fixed manner within the sleeve 63 until the locking element 70 is pulled out of the sleeve 63 again. Other locking elements 70 or clamping devices can also be inserted.

In the illustrated embodiment, the flexible deflection element 11 is formed as a wire or wire cable. It is obviously also possible to provide a band or belt as a deflection element, wherein in this case the deflection pulleys 16, 18 and 19 need to be modified accordingly, because respective groove-shaped receivers for the cable are formed in the deflection pulleys 16, 18 and 19.

The synchronisation mechanism 10 can also be used in three or more pull-out guides instead of two pull-out guides 1 in order to unify the movement of the respective running rails.

The arrangement of the deflection pulleys can also be reversed in an alternative embodiment, so that the connecting section between the at least two pull-out guides and the respective two deflection pulleys is situated in the front region of the pull-out system and the one respective deflection roller is arranged in the rear region of the pull-out system.

Figure 5:
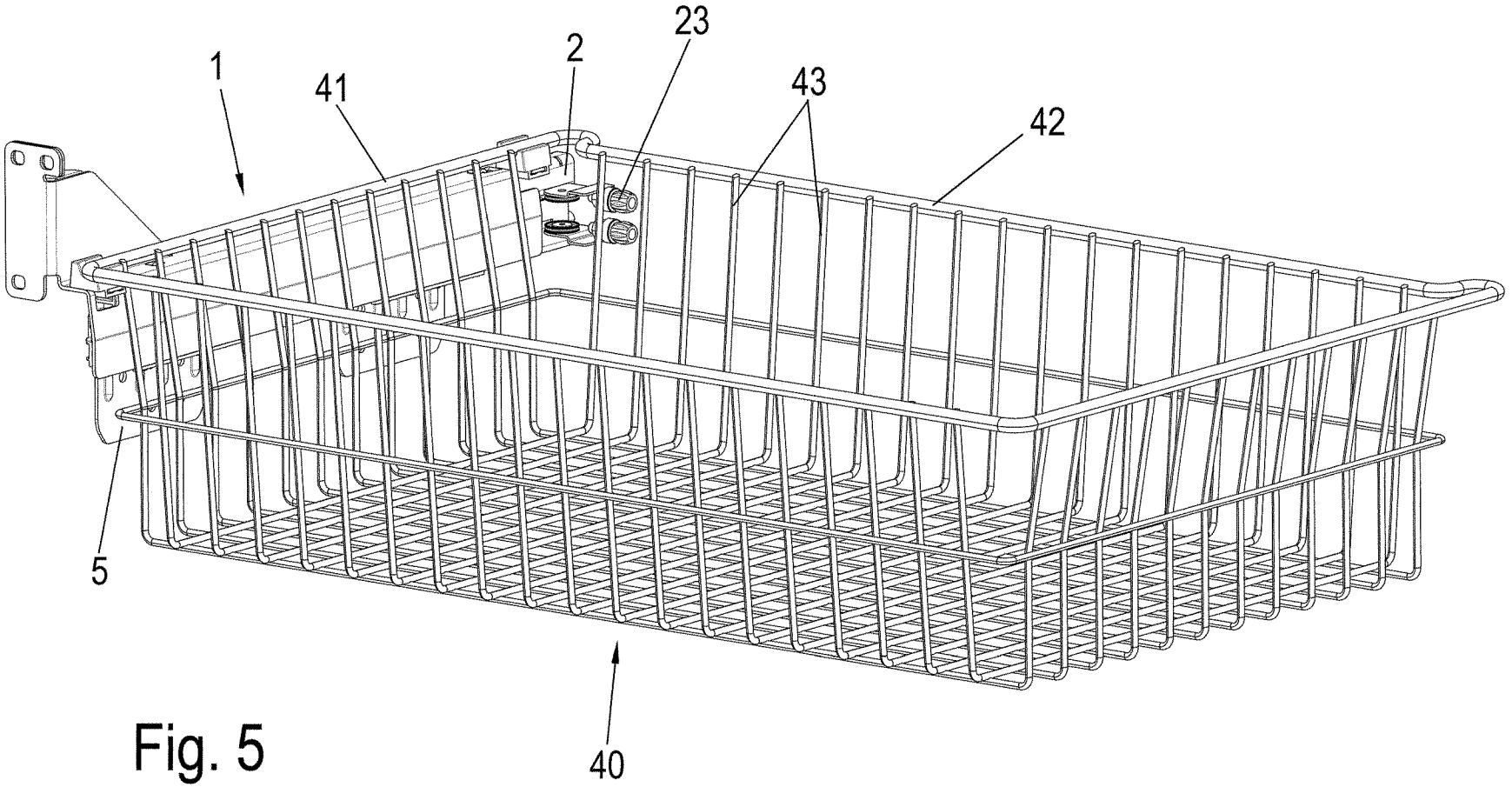
FIG. 5 shows a perspective view of a basket as a drawer element in a pull-out system in accordance with the disclosure.

The pull-out system in accordance with the invention may be used in furniture or domestic appliances or in other applications. FIG. 5 shows an embodiment in which a basket 40 of a refrigerating device is fixed to a pull-out guide 1. For this purpose, an upper strut 41 of the basket 40 is fixed to the running rail 2 of the pull-out guide 1. The basket comprises several vertical struts 43, which are connected via horizontal struts 42 to each other, so that a lattice-like configuration is produced. A drawer or any other drawer element can be mounted on a pull-out system in accordance with the invention instead of a basket 40.

The invention clamed is:

1. A pull-out system, comprising:

two pull-out guides, each pull-out guide comprising a stationary rail, a running rail, and a middle rail, the running rail and the middle rail being moveable relative to the stationary rail;

a flexible deflection element configured to synchronize the movement of the movable rails wherein the flexible deflection element is retained on the middle rail of each pull-out guide via at least one respective deflection pulley;

an enclosure disposed between the two pull-out guides, the enclosure surrounding a portion of the deflection element, the enclosure displaceable independently of the deflection element;

a tensioning sleeve acting on a side of the enclosure;

a spring acting on the tensioning sleeve, the spring and tensioning sleeve operable to displace the enclosure independently of the deflection element to set a tension of the deflection element; and a locking element operable to lock the tension of the deflection element.

2. A pull-out system according to claim 1, characterized in that the flexible deflection element is movable together with the at least one movable rail.

3. A pull-out system according to claim 1, characterized in that the flexible deflection element is arranged with a section parallel to a longitudinal direction of at least one of the two pull-out guides and a connecting section perpendicular to the longitudinal direction.

4. A pull-out system according to claim 1, characterized in that the flexible deflection element is guided via the at least one respective deflection pulley.

5. A pull-out system according to claim 4, characterized in that the flexible deflection element and/or the at least one respective deflection pulley is arranged on at least one support which is connectable to one of the pull-out guides.

6. A pull-out system according to claim 1, characterized in that the tension of the deflection element is adjustable by a change in the length of the enclosure around the deflection element and/or by a displacement of at least one retainer parallel to the longitudinal direction of one of the pull-out guides.

7. A pull-out system according to claim 1, characterized in that the flexible deflection element is formed as a continuous loop or is formed from several subcomponents.

8. A pull-out system according to claim 1, characterized in that the flexible deflection element is respectively deflected about the at least one respective deflection pulley.

9. A pull-out system according to claim 1, characterized in that the flexible deflection element is fixed at a first connection point to the stationary rail of one of the pull-out guides and at a second connection point to the movable rail of one of the pull-out guides.

10. A pull-out system according to claim 1, characterized in that the flexible deflection element is formed as a wire cable.

11. A domestic appliance comprising a pull-out system, the pull-out system comprising:

two pull-out guides, each pull-out guide comprising a stationary rail, a running rail, and a middle rail, the running and the middle rail being moveable relative to the stationary rail;

a flexible deflection element configured to synchronize the movement of the movable rails wherein the flexible deflection element is retained on the middle rail of each pull-out guide via at least one respective deflection pulley;

an enclosure disposed between the two pull-out guides, the enclosure surrounding a portion of the deflection element, the enclosure displaceable independently of the deflection element;

a tensioning sleeve acting on a side of the enclosure;

a spring acting on the tensioning sleeve, the spring and tensioning sleeve operable to displace the enclosure independently of the deflection element to set a tension of the deflection element; and a locking element operable to lock the tension of the deflection element.

* * * * *